United States Patent [19]

Lau

[11] Patent Number: 4,818,464

[45] Date of Patent: Apr. 4, 1989

[54] EXTRUSION PROCESS USING A CENTRAL AIR JET

[75] Inventor: Jark C. Lau, Roswell, Ga.

[73] Assignee: Kimberly-Clark Corporation, Neenah, Wis.

[21] Appl. No.: 872,992

[22] Filed: Jun. 11, 1986

Related U.S. Application Data

[63] Continuation of Ser. No. 645,668, Aug. 30, 1984, abandoned.

[51] Int. Cl.[4] ..... B65H 54/00

[52] U.S. Cl. ..... 264/510; 156/167; 264/12; 264/518; 264/555; 264/174; 264/211.14; 425/7; 425/72.2

[58] Field of Search ..... 425/6, 7, 10, 72 R, 425/72 S, 46 R–464, 72.1, 72.2; 264/5, 6, 11, 12, 13, 109, 115, 121, 123, 165, 125–127, 176.1, 204–208, 174, 211.14, 211.16, DIG. 75, 510, 518, 555; 156/244.11, 244.13, 244.14, 244.21, 166, 167, 180

[56] References Cited

U.S. PATENT DOCUMENTS

| | | | |
|---|---|---|---|
| 2,297,726 | 10/1942 | Stephanoff | 264/12 |
| 2,437,263 | 3/1948 | Manning | 264/DIG. 75 |
| 2,508,462 | 5/1950 | Marshall | 264/12 |
| 2,967,327 | 1/1961 | Ladisch | 264/14 |
| 3,224,852 | 12/1965 | Stalego | 264/12 |
| 3,981,650 | 9/1976 | Page | 264/211.14 |
| 3,995,001 | 11/1976 | Vroomans et al. | 264/14 |
| 4,167,548 | 9/1979 | Arduini et al. | 264/12 |
| 4,211,737 | 7/1980 | Di Drusco et al. | 264/12 |
| 4,536,361 | 8/1985 | Torobin | 425/7 |

FOREIGN PATENT DOCUMENTS

| | | | |
|---|---|---|---|
| 2738052 | 3/1979 | Fed. Rep. of Germany | 264/12 |

*Primary Examiner*—Jan H. Silbaugh
*Assistant Examiner*—Jill L. Heitbrink
*Attorney, Agent, or Firm*—William D. Herrick

[57] ABSTRACT

A thermoplastic material extrusion mechanism is provided which includes a die head having a centrally disposed high velocity gas delivery means adapted to continuously emit a jet of a gas having shear layers, at least one chamber for the thermoplastic material, thermoplastic material delivery means arranged at least partially surrounding the centrally disposed high velocity gas delivery means for directing extruded thermoplastic material emitted from the thermoplastic material delivery means toward the gas jet, causing the extruded thermoplastic material to be introduced into the shear layers of the gas jet, and a thermoplastic material conduit which communicates the at least one chamber with each of the thermoplastic material extrusion openings. A method of producing fibers of a thermoplastic material is also provided which comprises the steps of (a) forming a high velocity gas jet having shear layers, (b) extruding at least one stream of a molten thermoplastic material from at least one thermoplastic material delivery means arranged adjacent and at least partly surrounding the high velocity gas jet, and (c) merging the at least one thermoplastic material stream with the shear layers of the high velocity gas jet to attentuate the thermoplastic material into fibers, forming thereby fiber streams of the thermoplastic material.

10 Claims, 6 Drawing Sheets

EXTRUSION PROCESS USING A CENTRAL AIR JET

This is a continuation of co-pending application Ser. No. 645,688, filed on Aug. 30, 1984, now abandoned.

TECHNICAL FIELD

The present invention relates to an extrusion process for producing fibers and nonwoven mats therefrom and to an apparatus used therefor. More particularly, the present invention relates to melt-blowing processes in which a thermoplastic material in molten form is extruded from outlet nozzles such that the molten extrudate merges with the shear layers of a gas jet emanating from a high velocity gas delivery nozzle.

BACKGROUND ART

Various known melt blowing processes have been described in "Superfine Thermoplastic Fibers" by Wente, *Industrial and Engineering Chemistry,* Volume 48, Number 8, Pages 1342–1346, August 1956, "Manufacture Of Superfine Organic Fibers", *Naval Research Laboratory Report,* Number 111437, 1954, and U.S. Pat. No. 3,676,242 to Prentice. Apparatuses suitable for use in such processes are described in "An Improved Device For The Formation Of Superfine, Thermoplastic Fibers", by K. D. Lawrence et al, *Naval Research Laboratory Report,* Number 5265, Feb. 11, 1959, and in U.S. Pat. No. 3,981,650 to Page.

Nonwoven mats produced by these and other currently known melt blowing processes and the apparatuses used therefor employ an extruder to force a hot melt of thermoplastic material through a row of fine orifices and directly into converging high velocity streams of heated gas, usually air, arranged on alternate sides of the extrusion orifices. Fibers of the thermoplastic material are attenuated within the gas stream, the fibers solidifying at a point where the temperature is low enough.

DISCLOSURE OF INVENTION

The present invention provides the potential to at least double the throughput rate realized by currently used melt blowing processes and apparatuses used therefor.

The apparatus and method of the present invention also permit the formation of composite webs of two or more different polymers.

The present invention further provides enhancement of quenching of fibers or filaments formed by the method of the present invention due to the closer proximity of the fibers to the quenching air or water vapor used in the process.

The present invention additionally provides more quiescent exit conditions for extruded thermoplastic material, resulting in less flow disturbance in the downstream region.

The present invention also permits the entanglement of filaments or fibers in the initial shear region in which turbulence scales are smaller.

These and other advantages of the present invention are provided by a melt blowing device which includes a die head having at least one centrally disposed high velocity gas or fluid delivery means which is adapted to continuously emit a jet of fluid, preferably a gas. The die head also includes at least one chamber for thermoplastic material. At least one thermoplastic material delivery means, such as one or more thermoplastic material extrusion openings for emitting molten thermoplastic material, are formed in the die head adjacent to the high velocity gas delivery means. The centrally disposed high velocity gas delivery means may be placed between or surrounded by the one or more thermoplastic extrusion openings. When more than one thermoplastic extrusion opening is used, more than one thermoplastic material may be supplied to individual extrusion openings from separate chambers. Conduit means for fluid communication between the chamber or chambers and each of the thermoplastic material extrusion openings are provided for transfer of the thermoplastic material. A means for supplying the thermoplastic material to the chamber or chambers is also provided. The thermoplastic material extrusion openings are arranged to direct the extruded thermoplastic material toward the gas jet such that the extruded thermoplastic material is introduced into the shear layers of the gas jet. A depositing surface may be provided for collection of streams of attenuated fibers which are formed by the extruded thermoplastic material after contact with the jet of gas.

The present invention also contemplates a method of producing melt blown fibers and forming a nonwoven mat therefrom according to the steps in which at least one centrally placed high velocity gas stream or jet is formed and at least one stream, generally two or more streams, of a molten thermoplastic material extruded from at least one thermoplastic material extrusion opening or orifice which at least partially surrounds the at least one centrally placed high velocity gas jet is merged with the shear layers of the latter. This results in the formation of at least one stream of fibers of the thermoplastic material which may be directed onto a collecting surface, forming thereby a melt blown nonwoven mat. Unlike the present invention, melt blowing processes for producing nonwoven mats known heretofore have extruded fiber-forming thermoplastic polymer resin in molten form through orifices of a heated nozzle into generally two streams of a hot inert gas supplied by jets which at least partially surround the extrusion orifices to attenuate the molten resin as a single stream or row of fibers which are thereafter collected on a receiver to form a nonwoven mat.

BEST MODES FOR CARRYING OUT THE INVENTION

While the invention will be described in connection with certain preferred embodiments, it is to be understood that the invention is not to be limited to those embodiments. On the contrary, it is intended to cover all alternatives, modifications, and equivalents as can be included within the spirit and scope of the invention as defined in the appended claims.

Figure 1:
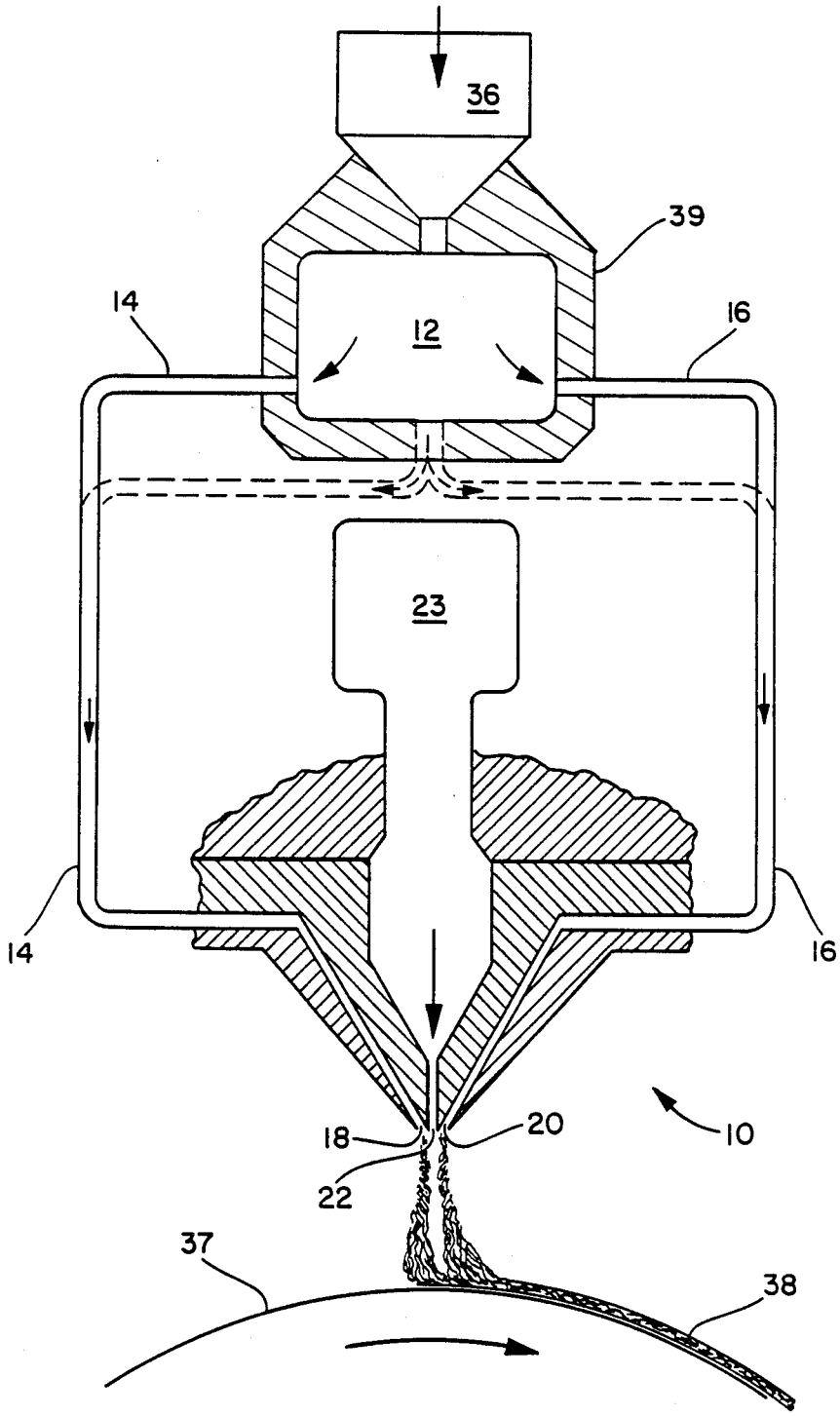
FIG. 1 is a somewhat schematic side elevational view of a thermoplastic flow diagram showing a die head having a structure and operation according the principles of the present invention.

One embodiment of the present invention is illustrated in FIG. 1 in which a die head or extrusion head 10 is provided with a chamber 12 for containing a polymeric, generally a thermoplastic material. The thermoplastic material may be supplied to chamber 12, generally under pressure, by delivery means or devices 36 such as a supply hopper and an extruder screw or the like. The thermoplastic material may be rendered fluid or molten by one or more heaters 39 placed appropriately, such as surrounding the chamber 12, surrounding the hopper and/or between the hopper and the chamber. As shown in FIGS. 1 and 3*a–f*, chamber 12 is provided with outlet passages 14 and 16 which permit the flow of molten thermoplastic material from the chamber to a plurality of thermoplastic extrusion outlets, openings or orifices 18 and 20 or a single such opening 19 located in a preferably circular die tip and arranged surrounding a centrally placed means for delivering a generally inert gas as, for example, air, at a high velocity, wih an opening such as a nozzle 22 or the like from a source of inert gas 23. Like the thermoplastic material, the air emanating from the high velocity nozzle may be heated by a heater (not shown), appropriately placed, such as in or surrounding the source of inert gas 23 or nozzle 22 itself. Alternatively, chamber 12 may be provided with a single outlet (shown in phantom in FIG. 1) which branches or forks into two or more passages. As used herein in referring to the inert gas or a jet of inert gas, "high velocity" generally describes jets having velocities of about 300 to over 2,000 feet/second. Also as used to describe the present invention, the terms "central" or "centrally", as applied to the gas delivery means or jets, generally includes all situations in which the gas delivery means is surrounded by or arranged between thermoplastic extrusion openings or a portion thereof.

According to the present invention, there may be as few as a single thermoplastic extrusion opening 19 surrounding or at least two thermoplastic extrusion openings 18 and 20 placed around an opening comprising the high velocity gas delivery means or air nozzle 22. However, as is more common among melt blown die tips, the high velocity gas delivery means 22 has the form of an elongated opening or slot and a series of individual thermoplastic extrusion openings or slits 18 and 20 are arranged in rows on opposite sides of the gas delivery means 22 as in FIGS. 3*a* and 3*b*. The openings 18 and 20 are arranged such that their longitudinal axes form an included angle with the longitudinal axis of the high velocity gas delivery nozzle of about 30 degrees to less than about 90 degrees. As indicated by the embodiment shown in FIG. 2, typically this angle is about 60 degrees.

Figure 3A:
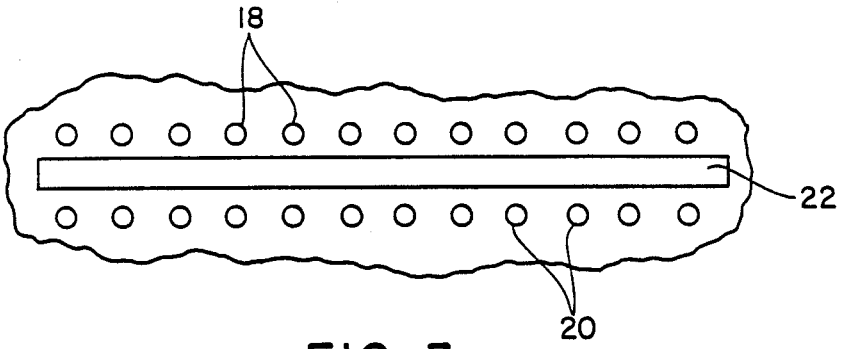
FIGS. 3*a–f* illustrate bottom views of die tips of the present invention including thermoplastic material extrusion openings and centrally disposed high velocity gas delivery means.
Figure 3B:
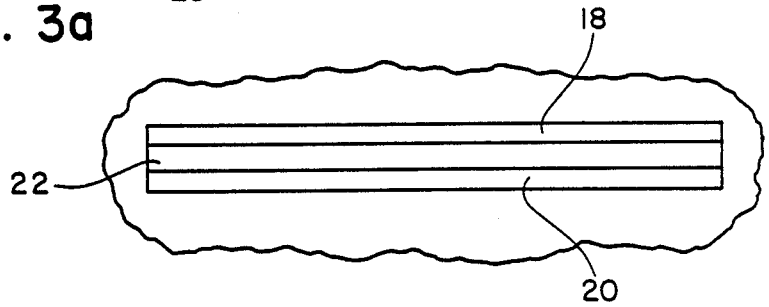
Figure 3C:
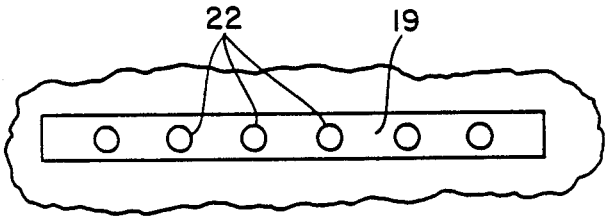

Some of the arrangements of the centrally placed gas jet and thermoplastic extrusion openings of the present invention, as viewed from the bottom, are shown in FIGS. 3*a*–f. One preferred arrangement is shown in FIG. 3*a* in which two series of holes 18 and 20 are arranged in rows substantially parallel to and on opposite sides of nozzle 22, formed as a linear, elongated opening or slot. Each of the openings in series 18 may be arranged opposite to a corresponding hole in series 20. Alternatively, the holes in the two series may have a staggered or skewed relationship with respect to one another. FIG. 3*b* depicts an arrangement in which two thermoplastic extrusion openings 18 and 20 take the form of elongated linear openings or slits placed parallel to and on opposite sides of the elongated linear gas nozzle or slot 22. The arrangement shown in FIG. 3*c* provides for the inert gas to be emitted from capillary gas nozzles 22 arranged within an elongated slit 19 from which the polymeric material flows. Although nozzles 22 are arranged here linearly along a plane passing through the center and parallel to the elongated edges of the slit, other arrangements, such as an alternating or zigzag arrangement of the air nozzles, are also possible.

Figure 3D:
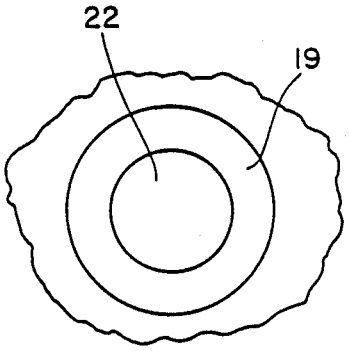
Figure 3E:
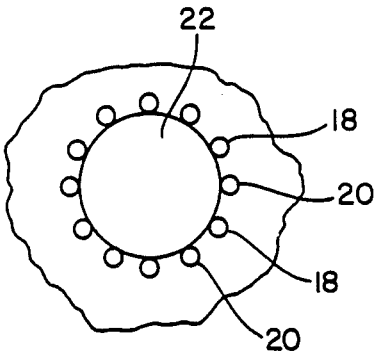
Figure 3F:
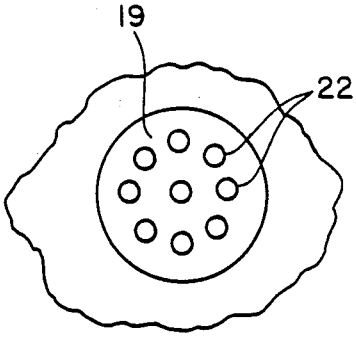

FIG. 3*d* illustrates an extrusion arrangement in which an inert gas nozzle 22, having a circular cross section, is arranged concentrically within a cylindrical opening so that the inner surface of the cylindrical opening and the outer surface of the inert gas nozzle form an annular extrusion opening 19. In this embodiment and the arrangement shown in FIG. 3*e*, the central air nozzle 22 may have a diameter of up to about two inches. The embodiment shown in FIG. 3*e* includes a plurality of thermoplastic polymer extrusion openings 18 and 20 arranged in spaced relationship to one another and to the inert gas nozzle around the circumference of the inert gas nozzle. Finally, FIG. 3*f* illustrates a plurality of capillary gas nozzles 22 arranged centrally within a thermoplastic extrusion opening 19 having a circular cross section.

Figure 4:
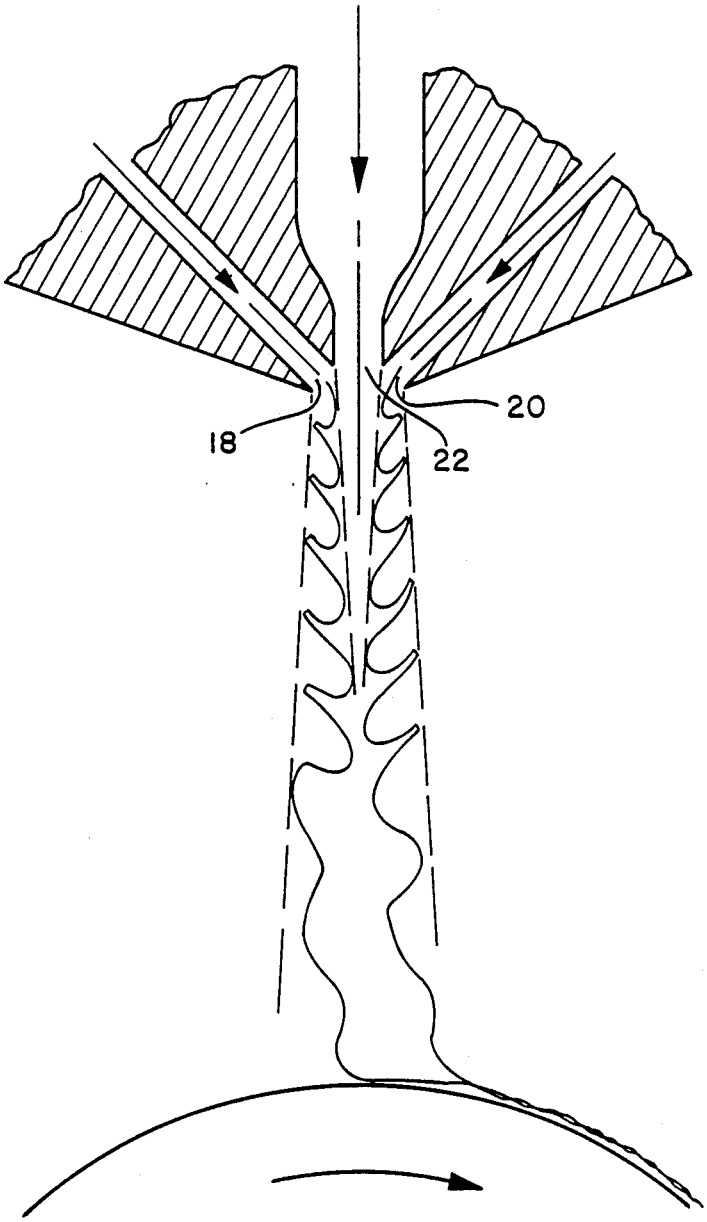
FIG. 4 is a schematic representation of the formation of filament streams in the shear layers of a gaseous jet.

The die head arrangement of the present invention permits molten thermoplastic material to be transferred from chamber 12 through the passages or conduits 14 and 16 to the extrusion openings 19 or 18 and 20, whereupon, as shown in FIG. 4, the molten extrudate emerges and contacts the shear layers of the at least one jet of high velocity gas which is being continuously emitted in a stream from the one or more centrally placed nozzles 22. As used herein, the shear layers are considered to be those layers or portions of the inert gas jet located in the peripheral regions of the jet. This arrangement results in a plurality of streams, preferably two streams, in the preferred embodiments shown in FIGS. 3*a* and 3*b*, of molten extrudate being first attenuated in the peripheral portions or shear layers of the jet or jets, thereby forming filaments or fibers which are mixed and directed to a forming or collecting foraminous surface 37, such as a roll, (shown in FIG. 8) or a moving wire placed in the vicinity of the die heads, where the fibers form a matrix or mat 38.

Since, with the exception of the embodiment shown in FIG. 3*d* in which the annular extrusion opening 19 extends around the circumference of the nozzle opening 22, at least two streams of thermoplastic material extrudate are formed by the extrusion head of the present invention, which streams may be ultimately attentuated to form fine filaments or fibers in the nonwoven mat, the present invention provides the potential to more than double the throughput rate of fiber formation compared to existing processes and apparatus used therefor. In addition, since the filaments formed by the die head of the present invention are attenuated in the shear layers of the high velocity gas stream, these filaments are closer to the air entrained from the atmosphere surrounding the apparatus, and quenching becomes much more effective than in conventional apparatus in which air jets converge on a centrally emitted stream of thermoplastic material.

Figure 2:
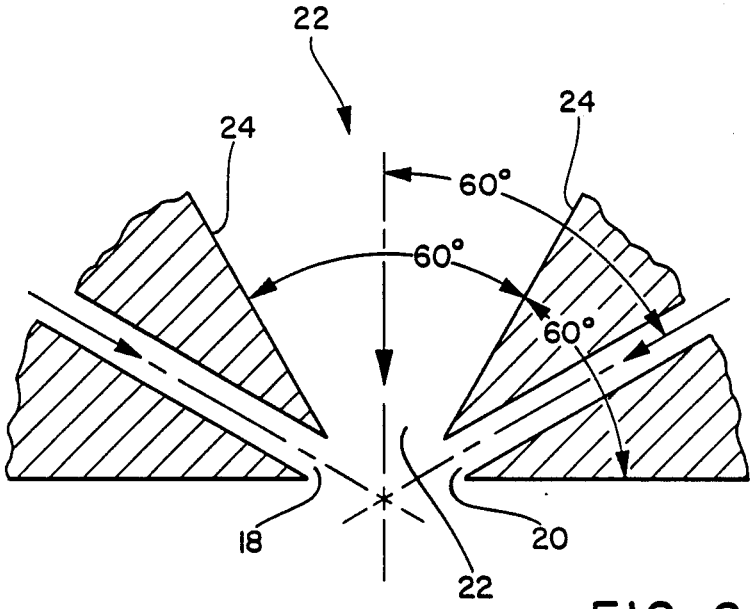
FIG. 2 is a side elevational view, in section, of an embodiment of the die tip of the present invention.
Figure 5:
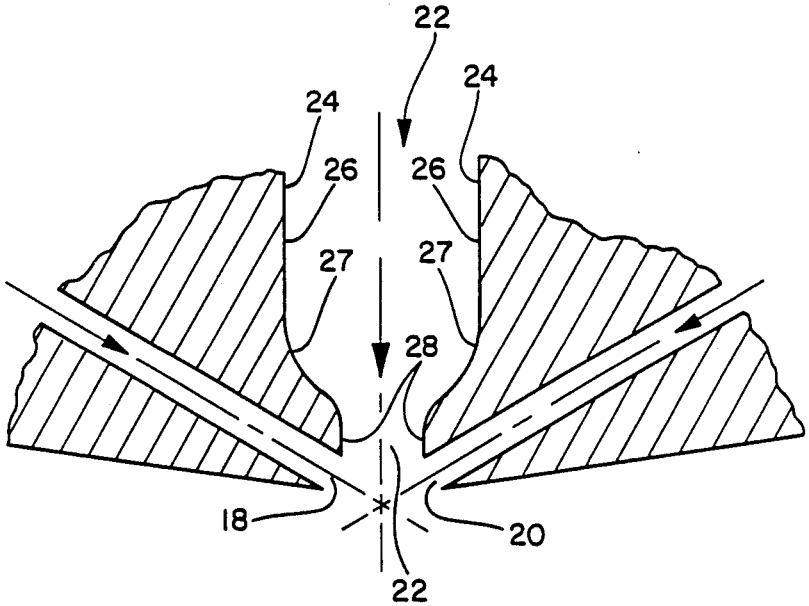
FIG. 5 is a side elevational view, in section, of an alternative embodiment of a die tip according to the present invention.
Figure 6:
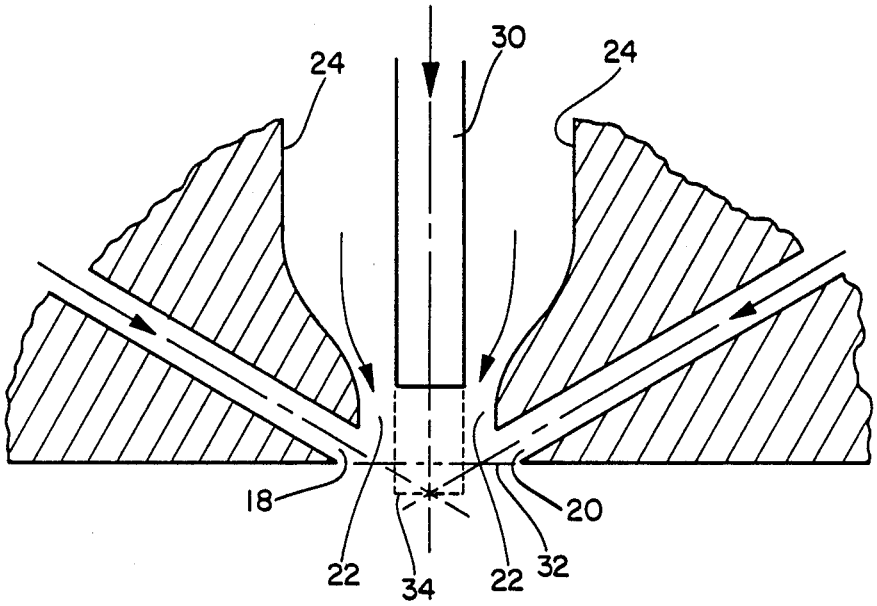
FIG. 6 shows an elevational view, in section, of an embodiment of a die tip according to the present invention provided with an auxiliary duct.
Figure 7:
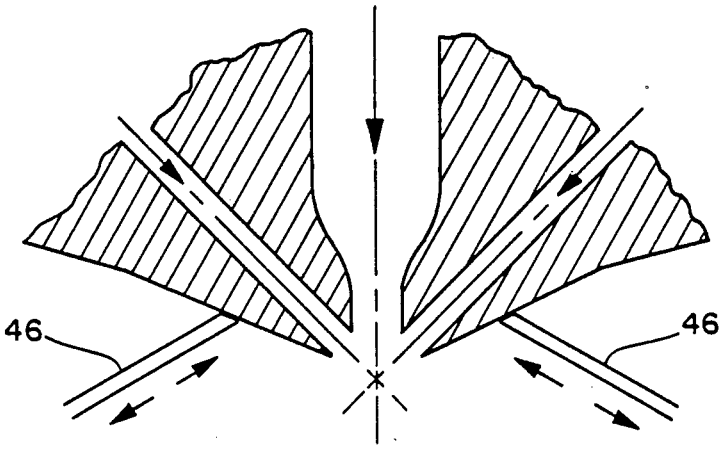
FIG. 7 illustrates in section a side elevational view of an embodiment of a die tip according to the present invention provided with a means for adjusting the slots.

FIGS. 2 and 5 illustrate in section several configurations of the exit portion of the high velocity gas delivery nozzle 22. Thus, the wall sections 24 of the outlet portion of the nozzle 22 may be straight and may be arranged substantially parallel to one another, as shown in FIGS. 5 to 7, or may be arranged to form an included angle with respect to each other, as is shown in FIG. 2. Typically, with this latter arrangement, the included angle formed by the wall sections of the tip of the high velocity gas outlet nozzle is about 60 degrees. With the other preferred wall configurations in which the wall sections 24 are substantially parallel, the tip of the nozzle has a slightly different configuration. As illustrated, the tip of the nozzle has a contoured or gradually curving and tapering configuration in which the outlet nozzle walls 26, which are arranged in approximately parallel relationship, taper through a gradual S-shaped configuration 27 to a more constricted nozzle tip 28 in which the walls are approximately parallel or arranged at a slight angle to one another.

Another embodiment of the present invention provides a means for introducing an additive to the air stream or jet which merges with the streams of molten extrudate. Thus, as illustrated in FIG. 6, a conduit, such as a tube or duct 30, may be placed concentrically within and spaced from the walls 24 of the high velocity gas delivery nozzle. As is illustrated in FIG. 6, the additive delivery conduit may take the form of a duct 30, the outlet end of which is recessed from the outer portion or exit plane 32 formed by the outer surfaces of the high velocity gas delivery nozzle. Alternatively, as is shown in phantom in FIG. 6, the additive delivery conduit may take the form of a duct 34, the outlet end of which extends from the outer portion or beyond the exit plane of the high velocity gas delivery nozzle. The end of the duct may also be arranged with the outlet end having a position between those shown in solid line or in phantom in FIG. 6, particularly one in which the outlet end of the duct is flush with plane 32. A means may also be provided to move the duct between the two positions illustrated.

The additive which is introduced into the air stream through the duct may be any gaseous, liquid (such as surfactants or encapsulated liquids), or particulate material (such as a superabsorbent material, i.e., a material capable of absorbing many times its weight of liquid, preferred being materials such as carboxymethyl cellulose and the sodium salt of a cross linked polyacrylate; wood pulp or staple fibers, as, for example, cotton, flax, silk or jute), which is intended to form part of the fibers or the finished web. The additive material may be fed from a source located within the extrusion head or remote therefrom. Although the velocities of the inert gas flowing through the high velocity gas delivery nozzle 22 and the mixture of gas and particles flowing through the duct 30 or 34 should be optimized, there is no need that they be the same. The material may be fed to the duct by any conventional means using gas as a conveying medium. Alternatively, the additive and a suitable fluidizing gas may be mixed and, in some instances, supplied to the duct 22 directly, thus eliminating the use of a duct.

Figure 8:
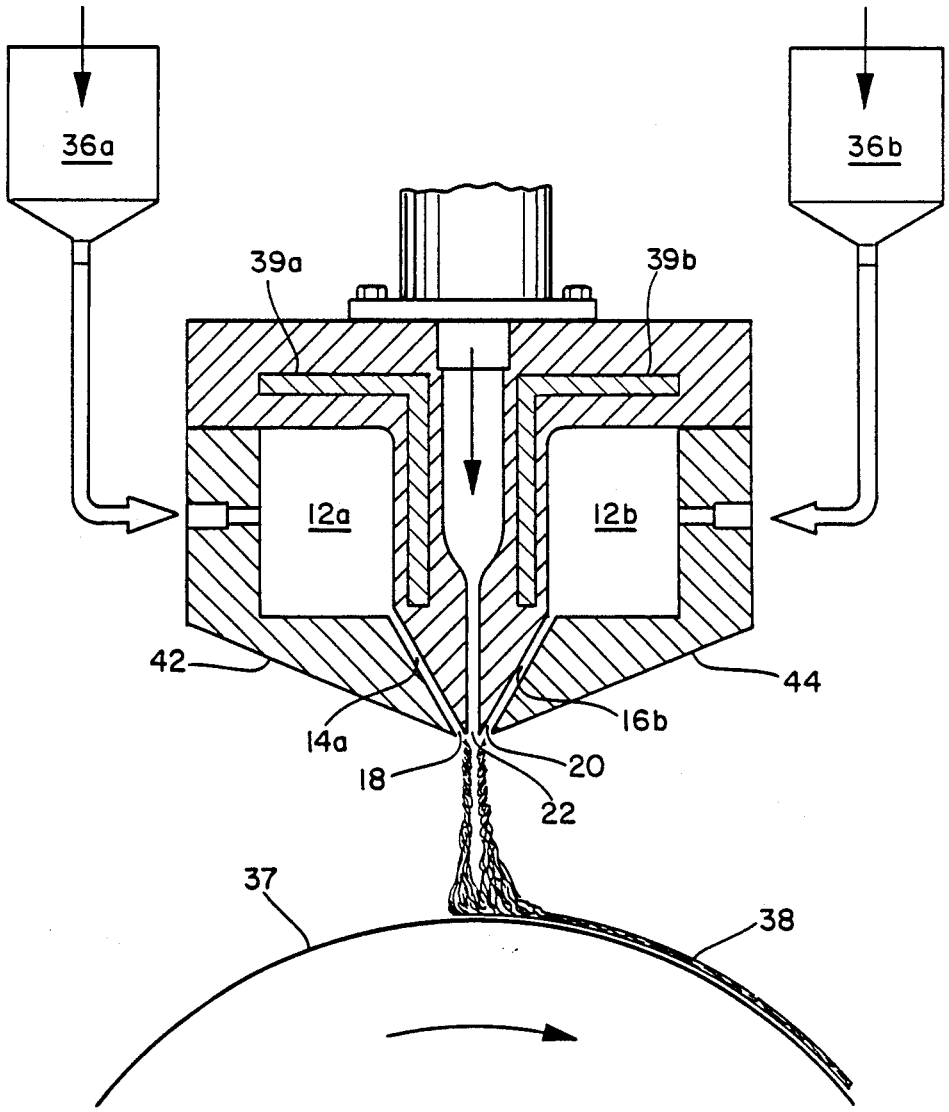
FIG. 8 is a somewhat schematic side elevational view of an embodiment of a die head provided with two thermoplastic material chambers.

In accordance with another aspect of the present invention, composite webs of two or more different thermoplastic materials may be formed. Thus, the present invention provides for the introduction of molten extruded thermoplastic material to the shear layers of at least one rapidly moving stream or jet of an inert gas from, with the exception noted above, two or more extrusion openings or sets of openings, such as 18 and 20, placed surrounding or on alternate or opposite sides of the high velocity gas delivery nozzle 22. The thermoplastic material which is extruded from these openings may be the same material or, alternatively, materials which differ from one another in their chemical and/or physical properties. Designated as first, second, . . . n thermoplastic materials, where n represents a plurality, the materials may be of the same or different chemical composition or molecular structure and, when of the same molecular structure, may differ in molecular weight or other characteristics which results in differing physical properties. In those situations in which thermoplastic materials are used which differ from one another in some respect, such as in physical properties, the extrusion or die head will be provided with multiple chambers, one for each of the thermoplastic materials, such as first, second, . . . n thermoplastic materials, where n represents a plurality. That is, as illustrated in FIG. 8, the die head is provided with a first chamber **12*a* for the first thermoplastic material and a second chamber 12*b* for the second thermoplastic material, etcetera. In contrast to the arrangement illustrated in FIG. 1, where a single chamber 12 is provided with conduits or passages 14 and 16 which provide communication between the single chamber and each of the first and the second thermoplastic extrusion outlet openings 18 and 20, when a first chamber 12*a* and a second chamber 12*b* are employed for first and second thermoplastic materials, respectively, each chamber is provided with passages to only one extrusion outlet opening or set of openings. Thus, the first thermoplastic material chamber 12*a* communicates with the first extrusion outlet opening 18 by means of the first thermoplastic material passage 14*a*, while the second thermoplastic material chamber 12*b* communicates with the second thermoplastic extrusion opening 20 through the second thermoplastic material passage 16*b***.

The extrusion head may be cast either as a single piece or may be formed in multiple component parts, preferably in two generally symmetrical portions 42 and 44 which are suitably clamped, bolted or welded together. Each of these portions may also be formed from separate parts which may also be suitably clamped, bolted or welded together. Depending upon the particular arrangement of the component elements of the system, when two or more chambers for thermoplastic material are employed, the die head may be provided with a suitable insulating material placed so as to reduce the thermal influences of air surrounding the apparatus or regions of the apparatus. Accordingly, insulation may, for example, be placed between the chambers and, perhaps, the thermoplastic material conduit means **14*a* and 16*b*. This permits, when suitable means are provided therefor, separate and independent control of appropriately placed heaters, such as 39*a* and 39*b* (FIG. 8) and, as a result, the temperatures of the thermoplastic materials supplied separately to the orifices 18 and 20**.

Thus, the first thermoplastic material having one set of properties may be maintained at a first temperature and the second thermoplastic material with a different set of properties may be maintained at a second temperature, etcetera. Similarly, the temperature of the gas and the polymers may be different. In addition, the heaters themselves and, perhaps, the means of delivering or supplying the thermoplastic material, may also be insulated. There may also be provided multiple (such as first and second) thermoplastic supply or delivery means for the first and second thermoplastic materials, unlike the apparatus shown in FIG. 1 in which a single thermoplastic material supply means and chamber are used. Like the apparatus containing a single thermoplastic material chamber, however, the apparatus of the present invention which uses two thermoplastic material chambers, includes delivery means which delivers thermoplastic material from a source thereof to the chambers under pressure. In the embodiment with multiple (first and second) thermoplastic material chambers, separate controls may be provided for supplying the thermoplastic material at different pressures.

In both the single piece and multiple part embodiments of the die head, the thermoplastic chambers may be formed by any suitable means, such as by appropriately coring or drilling the die head, and the openings and passages or conduits may be drilled.

It should also be noted that, although the discussion herein of the present invention has been directed to a common extrusion or die head containing all or most of the enumerated elements, most of these elements may be located remote from the die head employing suitable communicating means. Such structures may also include separate thermoplastic extrusion openings and centrally placed high velocity gas delivery nozzle(s), all with associated conduit means. The openings and outlets are arranged with the orientations and configurations previously described and shown in the drawings.

Both the high velocity gas delivery nozzle 22 and the extrusion openings 18 and 20 may have dimensions which vary widely depending upon the material being extruded and the concomitant parameters employed, as well as the arrangement of the component parts of the die head. Preferred widths of the air nozzle 22 at its effluent end contiguous to the extrusion surface, however, lie in the range of about 0.01 inch to about ⅛ inch but may be larger to permit unimpeded flow of a particulate additive, such as where an additive introduction duct 30, 34 or the like is employed. The preferred width of the polymer extrusion openings is about 0.005 inch to about 0.05 inch at their effluent ends contiguous to the polymer extrusion surface. The latter dimension is most preferably about 0.015 inch. The dimensions of the thermoplastic extrusion openings may also be made somewhat larger, however, to accommodate the centrally arranged high velocity gas delivery nozzles 22, as shown in FIGS. 3*c*, 3*d* and 3*f*.

The present invention also contemplates an embodiment in which the size of each of the first and second thermoplastic material slot openings is adjustable. This may be accomplished by suitable adjustment means as, for example, slot adjustment struts 46 as shown in FIG. 7.

As discussed above, a nonwoven mat formed from fibers of a polymeric or thermoplastic material may be formed according to the present invention by extruding and collecting multiple streams of thermoplastic material, that is, extruding a first stream of a molten thermoplastic material from one or more first thermoplastic material extrusion openings and concurrently extruding the same or a different molten thermoplastic material from one or more second thermoplastic extrusion openings, which first and second thermoplastic extrusion openings are arranged at least partially surrounding or on opposite sides of the high velocity gas nozzle. The extruded thermoplastic material is attenuated to fibers or filaments by a jet or stream of high velocity inert gas passing between the first and second streams of extruded thermoplastic material. The fibers form as the first and second thermoplastic material-containing streams merge with the shear layer of the inert gas stream, as shown in FIG. 4. The fibers are then directed onto a collecting surface, such as a hollow foraminous forming roll or a moving wire belt 37 located about 1 to about 16 inches from the die head. The fibrous web or mat 38 is formed largely when the fibers are deposited on the collecting surface. According to the method and apparatus of the present invention, some entanglement of the fibers may occur in the initial shear region where the streams of thermoplastic material merge with the inert gas stream and where the turbulence scales are generally smaller as well as further downstream at the confluence of the two streams of fibers.

The materials suitable for use in the present invention as polymeric or thermoplastic materials include any materials which are capable of forming fibers after passing through a heated die head and sustaining the elevated temperatures of the die head and of the attenuating air stream for brief periods of time. This would include thermoplastic materials such as the polyolefins, particularly polyethylene and polypropylene, polyamides, such as polyhexamethylene adipamide, polyomega-caproamide and polyhexamethylene sebacamide, polyesters, such as the methyl and ethyl esters of polyacrylates and the polymethacrylates and polyethylene terephthalate, cellulose esters, polyvinyl polymers, such as polystyrene, polyacrylonitrile and polytrifluorochloroethylene.

Any gas which does not react with the thermoplastic material under the temperature and pressure conditions of the melt blowing process is suitable for use as the inert gas used in the high velocity gas stream which attenuates the thermoplastic materials into fibers or microfibers. Air has been found to be quite suitable for such purposes.

The fibers may generally be formed in any configuration and diameter commensurate with the shape of the extrusion orifices.

The process of the present invention is capable of forming coarse fibers, that is, fibers having diameters generally up to about 100 microns and, in some instances, higher, but is generally directed to the formation of fine fibers, known also as microfibers or microfilaments. The microfibers produced by the present invention frequently have diameters in the range of about 1 to about 20 microns; however, microfibers may be formed having diameters down to as fine as 0.1 micron. Among the limiting factors which determine the ability of a given thermoplastic material or polymer to attentuate to a fine fiber are the parameters of the extrusion system, the nature of the polymeric material, such as the material's molecular weight, melting point, surface tension and viscosity-temperature characteristics, and the pressures and flow rates of air. Optimum conditions for any particular thermoplastic material may be achieved by varying such operating parameters as air temperature, nozzle temperature, air velocity or pressure, and the polymer feed rate or ram pressure. These and other variables may be easily determined by one familiar with melt blowing processes. Ample guidance, however, is provided by Wente in "Superfine Thermoplastic Fibers", *Industrial And Engineering Chemistry,* Volume 48,Number 8, Pages 1342–1346 (1956); "Manufacture Of Superfine Organic Fibers", *Naval Research Laboratory Report Number* 11,437 (1954); Lawrence et al, "An Improved Device For The Formation Of Superfine Thermoplastic Fibers", *Naval Research Laboratory Report Number* 5265 (1959); and U.S. Pat. Nos. 4,041,203; 4,100,324; 3,959,421; 3,715,251; 3,704,198; 3,692,618; 3,676,242; 3,595,245; 3,542,615; 3,509,009; 3,502,763; 3,502,538; 3,341,394; 3,338,992; and 3,276,944; British Specification No. 1,217,892; and Canadian Patent No. 803,714.

Generally, the operating conditions may be summarized as follows. The air temperature suitable for attenuating microfibers may be as low as ambient temperature. However, it is ordinarily on the order of at least 200 degrees F. above the melting point of the thermoplastic material, although under certain conditions some materials, such as the polyolefins, particularly polyethylene, and polystyrene, require air temperatures on the order of 300 degrees F. above the melting or softening points of the thermoplastic materials. When polypropylene is chosen as the polymeric material, a temperature in the range of about 400 to about 700 degrees F. is generally used.

The time during which the thermoplastic material remains and becomes attentuated in the heated, high velocity inert gas stream is relatively short and there is, therefore, relatively little chance of degradation of the thermoplastic material occurring when elevated temperatures are employed. However, generally the thermoplastic material remains in a heated portion of the die head for a longer period of time than when it is in the high velocity inert gas stream and the susceptibility to degradation increases with both the residence time in the die head and the temperature at which the thermoplastic material is maintained. Therefore, when polymer degradation is being sought, this may be achieved by control of the residence time of the polymer in the die head and the delivery system upstream. Generally, a thermoplastic material extrusion opening or polymer nozzle temperature may be used which is about equal to or as much as 200 degrees Fahrenheit above the air temperature, depending upon the residence time within the heated portion of the die head. The temperature of the polymer nozzle is not normally controlled, however, to achieve or maintain a particular temperature. Rather, the temperature of the thermoplastic material extrusion openings is determined in large part from the heat given up by the thermoplastic material passing through the openings and the surrounding air, both that passing through the high velocity gas delivery nozzle and ambient air. In some instances, in order to maintain the polymer nozzles within a certain temperature range, insulation may be placed around the polymer nozzles, the high velocity gas delivery nozzle, or both.

The velocity of the heated inert gas stream, which depends at least in part on the gas pressure, also varies considerably depending upon the nature of the thermoplastic material. Thus, with some thermoplastic materials, such as the polyolefins, particularly polyethylene, air pressures on the order of 1 to 25 psi may be suitable whereas other thermoplastic materials may require 50 psi for fibers of the same diameter and length. Consistant with such variables, the air pressure generally is in the range of 1 to about 60 psig.

As suggested above, one of the advantages realized with the present invention, as compared to known melt-blowing apparatus and methods which employ a single thermoplastic extrusion material opening or set of openings, is the increase in throughput rates. Whereas a standard single row or set of openings will frequently be operated at a rate of 3 pounds/inch/hour with a maximum rate on the order of 25 pounds/inch/hour, the present invention permits a comparable operating rate of 6 pounds/inch/hour up to a rate of about 50 pounds/inch/hour.

It should be clearly understood by those skilled in the art that certain changes may be made in the foregoing apparatus and method without departing from the spirit and scope of the invention described herein.

I claim:

1. A method of producing fibers of a thermoplastic material comprising the steps of:

(a) forming a centrally positioned high velocity gas jet having initial jet shear layers of small scale turbulence located in the peripheral regions of the jet adjacent an outlet of thermoplastic material delivery means;

(b) extruding at least two streams of a molten thermoplastic material from said outlet of thermoplastic material delivery means, said thermoplastic material delivery means arranged at least partly surrounding an outlet of said high velocity gas jet;

(c) merging said at least two molten thermoplastic material streams with the shear layers of said high velocity gas jet to attenuate said thermoplastic material into fibers within said shear layers forming thereby a plurality of reduced diameter fiber streams of said thermoplastic material with said high velocity gas jet located between said fiber streams; and (d) directing said plurality of fiber streams with said high velocity gas jet between them onto a collecting surface, forming thereby a melt blown nonwoven mat.

2. The method according to claim 1 wherein said at least two streams of a molten thermoplastic material comprise at least one first thermoplastic material stream and at least one second thermoplastic material stream and said thermoplastic material delivery means comprises at least one first thermoplastic material extrusion opening from which said at least one first thermoplastic material stream is extruded and at least one second thermoplastic material extrusion opening from which said at least one second thermoplastic material stream is extruded concurrently with said at least one first thermoplastic material stream such that said at least one first and second thermoplastic material streams merge with the shear layers of said high velocity gas jet and form thereby at least one first thermoplastic fiber stream and at least one second thermoplastic fiber stream, respectively.

3. The method according to claim 2 wherein a first thermoplastic material is extruded from said at least one first thermoplastic material extrusion opening and a second thermoplastic material is extruded from said at least one second thermoplastic material opening, said first and said second thermoplastic materials differing from each other in physical properties.

4. The method according to claim 1 wherein said high velocity gas jet includes a fluidized additive.

5. The method according to claim 4 wherein said fluidized additive includes a superabsorbent material.

6. The method according to claim 4 wherein said fluidized additive comprises wood pulp fibers.

7. The method according to claim 4 wherein said fluidized additive comprises staple fibers.

8. The method according to claim 4 wherein said fluidized additive is a liquid.

9. The method according to claim 4 wherein said fluidized additive is a gaseous additive.

10. The method according to claim 2 wherein said first and said second thermoplastic material streams merge with the shear layers of said high velocity gas jet forming an angle with said high velocity gas jet of about 30 degrees to less than about 90 degrees.

* * * * *